US007217162B2

(12) United States Patent
Harada et al.

(10) Patent No.: US 7,217,162 B2
(45) Date of Patent: May 15, 2007

(54) TABULAR TERMINAL-USE FEMALE TERMINAL

(75) Inventors: Tomonori Harada, Shizuoka (JP); Yoshinori Shigeta, Shizuoka (JP); Masanori Wakui, Aichi (DE); Keiichi Ito, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/402,150

(22) Filed: Mar. 31, 2003

(65) Prior Publication Data

US 2004/0077231 A1 Apr. 22, 2004

(51) Int. Cl.
*H01R 11/22* (2006.01)
*H01R 13/11* (2006.01)

(52) U.S. Cl. ..... 439/857

(58) Field of Classification Search ..... 439/856, 439/857, 852, 845, 849–850, 621–622, 374, 439/250, 366, 698, 830, 224, 381
See application file for complete search history.

(56) References Cited

U.S. PATENT DOCUMENTS

| | | | | | |
|---|---|---|---|---|---|
| 2,329,497 | A | * | 9/1943 | Washburn | 439/698 |
| 3,871,738 | A | * | 3/1975 | Dechelette | 439/830 |
| 4,083,623 | A | * | 4/1978 | Lynch | 439/741 |
| 4,379,611 | A | * | 4/1983 | Foege et al. | 439/747 |
| 4,553,808 | A | * | 11/1985 | Weidler et al. | 439/391 |
| 4,655,522 | A | * | 4/1987 | Beck et al. | 439/224 |
| 4,820,179 | A | * | 4/1989 | Saijo | 439/224 |
| 5,252,097 | A | * | 10/1993 | Lindeberg et al. | 439/856 |
| 5,833,500 | A | * | 11/1998 | Mahon et al. | 439/852 |
| 5,951,339 | A | * | 9/1999 | Chaillot et al. | 439/852 |
| 6,171,126 | B1 | * | 1/2001 | Wu et al. | 439/224 |
| 6,315,611 | B1 | * | 11/2001 | Sawada et al. | 439/619 |
| 6,840,824 | B2 | * | 1/2005 | Harada et al. | 439/857 |
| 7,004,797 | B2 | * | 2/2006 | Harada et al. | 439/857 |

FOREIGN PATENT DOCUMENTS

| | | |
|---|---|---|
| DE | 196 26 804 A1 | 1/1997 |
| DE | 196 11 720 C2 | 5/2000 |
| DE | 196 12 630 C2 | 9/2001 |
| DE | 100 12 262 C2 | 10/2002 |
| EP | 0 980 116 A1 | 2/2000 |
| JP | 7-11745 | 2/1995 |
| JP | 9-139250 | 5/1997 |

OTHER PUBLICATIONS

German Patent and Trademark Office, Munich; Office Action dated Oct. 22, 2003; Official File No. 103 14 227.4-34.

* cited by examiner

*Primary Examiner*—Felix O. Figueroa
(74) *Attorney, Agent, or Firm*—Armstrong, Kratz, Quintos, Hanson & Brooks, LLP

(57) ABSTRACT

A tabular terminal-use female terminal in which a tabular terminal is inserted is provided, which tabular terminal-use female terminal includes: a pair of elastic holding pieces extending in an insertion direction of the tabular terminal; a holding portion provided on each elastic holding piece for holding the tabular terminal; a guide face extending from each holding portion to an front end portion of each elastic holding piece for guiding the tabular terminal to the holding portion; and a receiving tapered portion provided on a side portion of each guide face, wherein the tabular terminal is able to be laterally inserted into the tabular terminal-use female terminal.

4 Claims, 3 Drawing Sheets

TABULAR TERMINAL-USE FEMALE TERMINAL

BACKGROUND OF THE INVENTION

1. Field of the Invention

The present invention relates to a female terminal wherein a tabular terminal can be laterally or obliquely inserted between a pair of elastic holding pieces thereof.

2. Description of the Related Art

A relay box with a fuse is provided in an electric wiring for various electric appliances aboard a vehicle for protecting the circuit. Here, the relay box is called a fuse box, a junction block or an electric junction box. As one of the fuses to be mounted on a fuse accommodating portion of the relay box, a blade-type fuse is known. The blade-type fuse has a pair of tabular terminals which are connected with a soluble portion in an insulative housing. This blade-type fuse is inserted into in the fuse accommodating portion of the relay box. Each of two tabular terminals is inserted between a pair of elastic contact pieces of the female terminal accommodated in the relay box.

The female terminal has a terminal body 40, a wire connecting portion 41 to crimp an electric wire (not shown), and a terminal contact portion 43 as shown in FIG.6. The terminal contact portion 43 has a pair of elastic holding pieces 42. The elastic holding piece 42 is formed of a rectangular plate. The pair of elastic holding pieces 42 are put into contact with each other near front end portions thereof. Each elastic holding piece 42 has a guide portion 44 between the front end and the contact portion. That is, the vicinity of the front end portion of each elastic holding piece 42 is in an L-shape. A front end portion of a tabular terminal 2 is inserted between the guide portions 44. The tabular terminal 2 is inserted deep, and the female terminal 45 is electrically connected to the tabular terminal 2. The fuse 3 is inserted in the fuse accommodating portion. When the tabular terminal 2 of the fuse 3 is inserted into the female terminal, a longitudinal axis al of the tabular terminal 2 is normally almost in parallel with a longitudinal axis b of the female terminal as shown in FIG.7. A width direction of the tabular terminal 2 and a width direction of the elastic holding piece 42 are substantially parallel.

However, as shown in FIG. 8, the fuse 3 is sometimes laterally or obliquely inserted in the fuse accommodating portion. At this time, as shown in FIG. 9, a side face 2*c* of the tabular terminal 2 abuts front-end side faces of the elastic holding pieces 42. In this case, the tabular terminal 2 is not inserted between the elastic holding pieces 42. If the fuse 3 is forcibly inserted, the tabular terminal 2 is damaged.

SUMMARY OF THE INVENTION

In view of the foregoing, an object of the present invention is to provide a tabular terminal-use female terminal wherein a tabular terminal can be laterally or obliquely inserted between a pair of elastic holding pieces.

In order to achieve the above object, as a first aspect of the present invention, a tabular terminal-use female terminal, in which a tabular terminal is inserted, comprises: a pair of elastic holding pieces extending in an insertion direction of the tabular terminal; a holding portion provided on each elastic holding piece for holding the tabular terminal; a guide face extending from each holding portion to a front end portion of each elastic holding piece for guiding the tabular terminal to the holding portion; and a receiving tapered portion provided on a side portion of each guide face, wherein the tabular terminal is able to be laterally inserted into the tabular terminal-use female terminal.

As a second aspect of the present invention, based on the first aspect, a largest gap of the receiving tapered portions is larger than a thickness of the tabular terminal.

As a third aspect of the present invention, based on the first aspect, a slant plane is formed on a side end face of, and near, the holding portion of each elastic holding piece.

As a fourth aspect of the present invention, based on the first aspect, a checking plate to restrain displacement of the pair of elastic holding pieces in a width direction thereof is provided.

As a fifth aspect of the present invention, based on any one of the first to fourth aspects, each elastic holding piece is formed by bending a rectangular plate in a L-shape.

According to the above-described structures of the present invention, the following advantages are provided.

(1) Even if the tabular terminal is laterally inserted, the tabular terminal is securely inserted without a damage.

(2) When the tabular terminal is laterally inserted, the corner portions of the side face of the tabular terminal are put into contact with the slant planes of the receiving tapered portions, and the elastic holding pieces open. Therefore, the tabular terminal can be more securely inserted.

(3) When the tabular terminal is laterally inserted, the corner portions of the side face of the tabular terminal move from the receiving tapered portions to the slant planes, and the elastic holding pieces open more smoothly. Therefore, the tabular terminal can be still more securely inserted.

(4) Because displacement of the elastic holding pieces in the width direction thereof is restrained by a checking plate, the elastic holding pieces can be easily opened. Therefore, the tabular terminal can be easily inserted between the elastic holding pieces.

(5) Because the elastic holding piece is in an L-shape, the elastic holding piece can be easily produced.

The above and other objects and features of the present invention will become more apparent from the following description taken in conjunction with the accompanying drawings.

DESCRIPTION OF THE PREFERRED EMBODIMENT(S)

Figure 1:
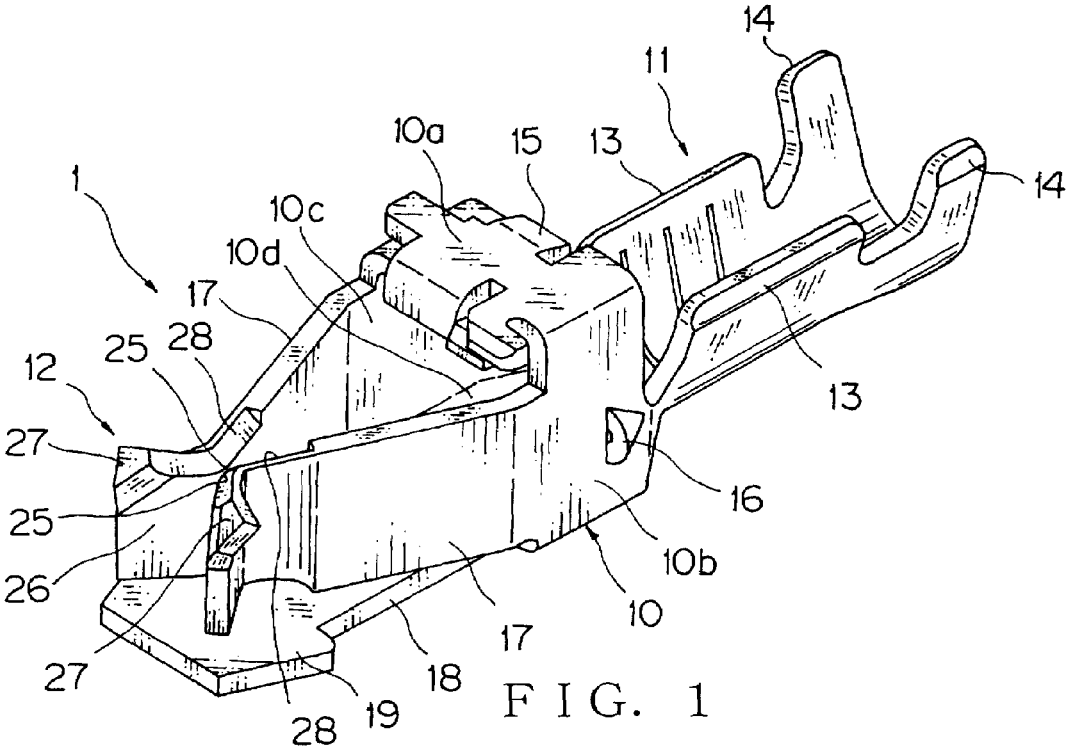
FIG. 1 is a perspective view showing an inventive tabular terminal-use female terminal.
Figure 3:
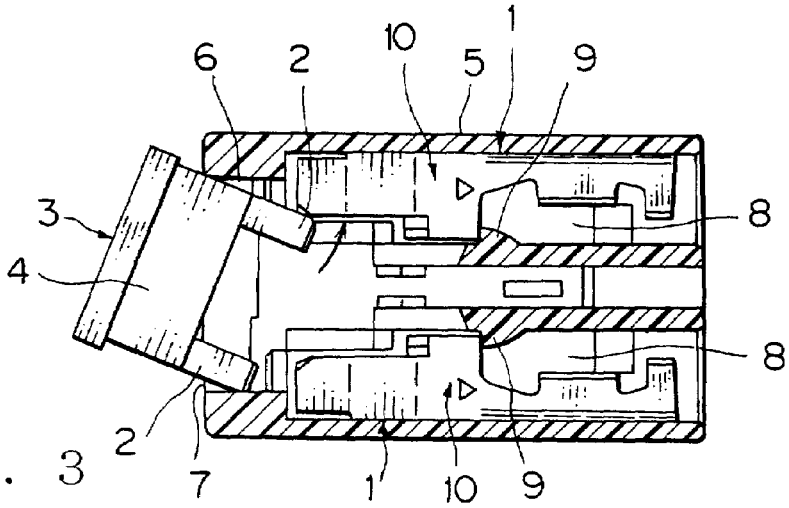
FIG. 3 is a longitudinal-sectional view showing a state that a fuse is laterally inserted into a relay box accommodating the inventive tabular terminal-use female terminal.
Figure 2:
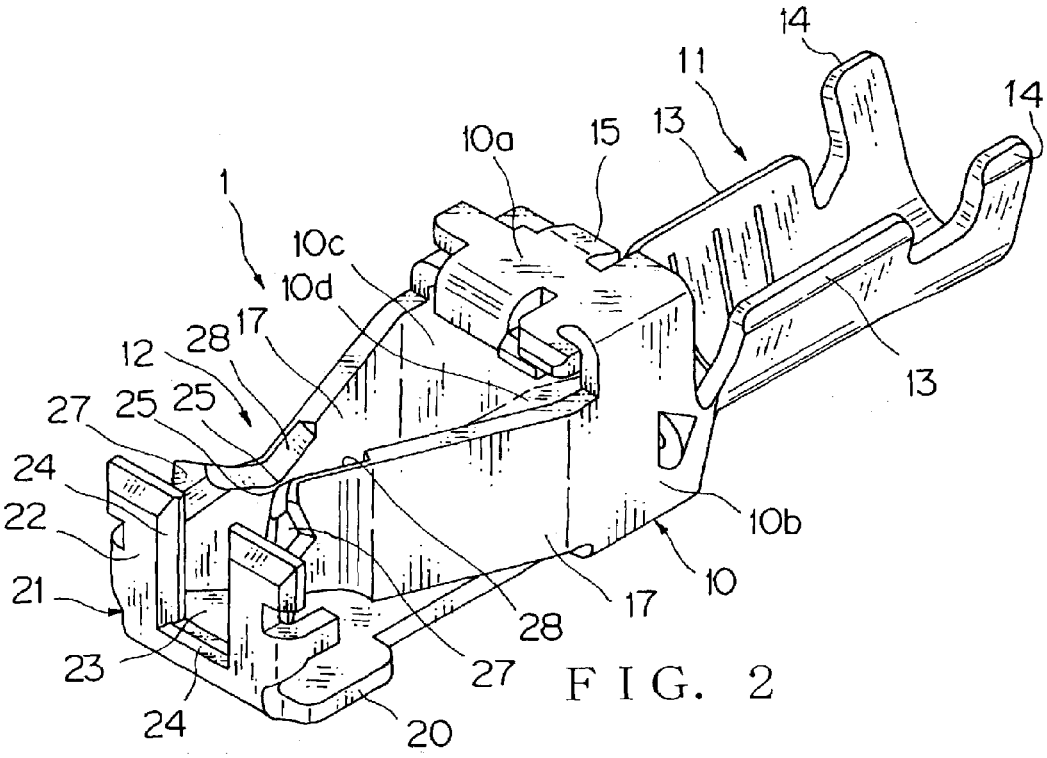
FIG. 2 is a perspective view showing another tabular terminal-use female terminal.
Figure 8:
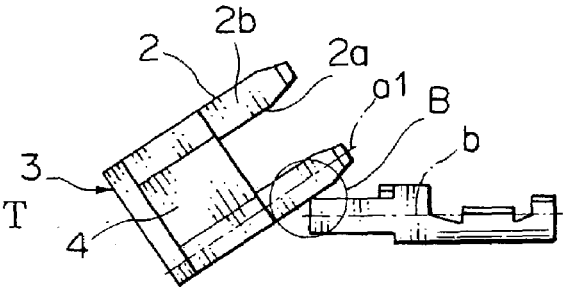
PRIOR ART FIG. 8
FIG. 8 is an explanatory illustration showing a state that the fuse is laterally put into contact with the prior art tabular terminal-use female terminal.
Figure 9:
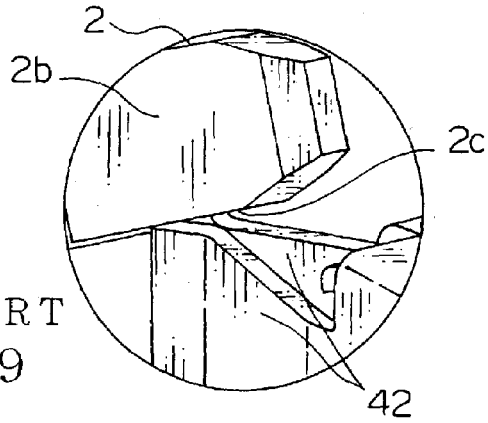
PRIOR ART FIG. 9
FIG. 9 is an enlarged view of B-portion of FIG. 8.

Embodiment(s) of the present invention will now be described in further detail with reference to the accompanying drawings. In FIG. 1 to FIG. 3, reference numeral 1 denotes a tabular terminal-use female terminal, and a tabular terminal 2 is inserted in the female terminal 1.

Figure 5:
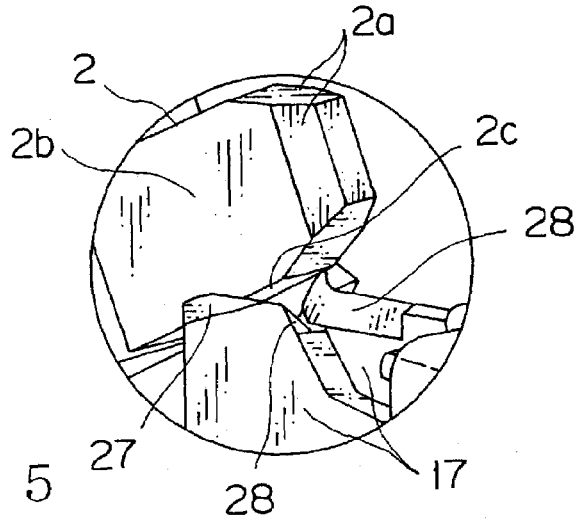
FIG. 5 is an enlarged view of A-portion of FIG. 4.
Figure 6:
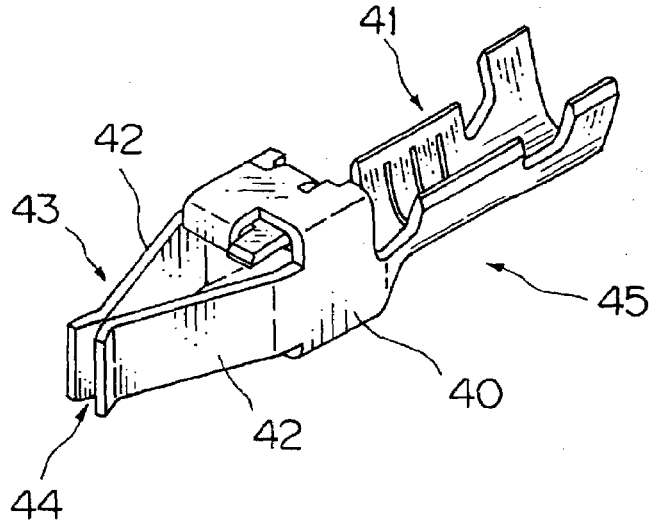
PRIOR ART FIG. 6
FIG. 6 is a perspective view showing a prior art tabular terminal-use female terminal.

Four tapered planes 2*a* are provided at front end portion of the tabular terminal 2 (FIG. 5). In the present embodiment, a tabular terminal of a blade-type fuse 3 is described.

The blade-type fuse 3 has a pair of tabular terminals 2 and an insulative housing 4. The pair of tabular terminals 2 are connected with a soluble portion (not shown) in the insulative housing. The pair of tabular terminals 2 are co-planar. Each tabular terminal 2 has a wide surface 2*b*. The blade-type fuse 3 is inserted in a fuse accommodating portion 5 of a relay box.

The fuse-accommodating portion 5 is formed in a box-shape with insulating material. A fuse-accommodating chamber 6 to receive the blade-type fuse 3 is provided at one end of the fuse accommodating portion 5. This fuse accommodating chamber 6 has a fuse insertion opening 7.

Two terminal accommodating chambers 8 parallel with each other are provided in the fuse accommodating portion 5. Each terminal accommodating chamber 8 communicates with the fuse accommodating chamber 5. A cross section of the terminal accommodating chamber 8 is quadrangular. The female terminal 1 is inserted from the other end of the fuse accommodating portion 5. A resilient lance 9 to engage the female terminal 1 for preventing a coming-out of the female terminal 1 is provided on one side wall of the terminal accommodating chamber 8. An engagement recess (not shown) which prevents the female terminal 1 from moving in an insertion direction thereof is provided on each of two opposite sidewalls of the fuse-accommodating box 5. The tabular terminal 2 of the blade-type fuse 3 is inserted in a terminal contact portion 12 of the female terminal 1.

The female terminal 1 is made of conductive material. As shown in FIG. 1 and FIG. 2, the female terminal 1 has a terminal body 10, a wire connecting portion 11, and the terminal contact portion 12. An electric wire (not shown) is crimped to the wire connecting portion 11. A lance engaging portion 15 to engage the lance 9 is provided on the first side portion 10*a* of the terminal body 10. An engaging projection 16 to engage the above engagement recess is provided on each of the second and third side portions 10*b*, 10*c* of the terminal body 10.

A pair of elastic holding pieces 17 are provided on the terminal contact portion 12. A checking plate 18 may be provided on the terminal contact portion 12. The checking plate 18 restrains displacement, from the first side portion 10*a* side to the fourth side portion 10*d* side, of the elastic holding pieces 17. The checking plate 18 is positioned on the outer wall of the fuse accommodating portion 5 when the female terminal 1 is accommodated in the terminal accommodating chamber 8. A triangular enlarged portion 19 (FIG. 1), a rectangular enlarged portion 20 (FIG. 2), or the like is provided at the front end portion of the checking plate 18.

A guide portion 21 to guide the tabular terminal 2 toward the elastic holding pieces 17 may be provided at the front end portion of the checking plate 18 as shown in FIG. 2. The guide portion 21 has a guide plate 22. A recess 23 to receive the tabular terminal 2 is provided on this guide plate 22. A tapered portion 24 is provided around the recess 23.

The pair of elastic holding pieces 17 face each other in a longitudinal direction of the female terminal 1. The pair of elastic holding pieces 17 extend mutually convergently from the second side portion 10*b* and the third side portion 10*c*, respectively. A holding portion 25 to hold the tabular terminal 2 is formed on each elastic holding piece 17. A guide face 26 is provided at the leading end of each elastic holding piece 17. The guide face 26 continues from the holding portion 25 to the front end of the elastic holding piece 17.

A receiving tapered portion 27 is provided at the front end portion of each elastic holding piece 17. The receiving tapered portion 27 is formed at a side portion of the guide face 26 of the elastic holding piece 17 so that when the tabular terminal 2 is laterally or obliquely inserted between the elastic holding pieces 17, corner portions of the side face 2c of the tabular terminal 2 are put into contact with the respective receiving tapered portions 27.

A slant plane 28 is formed on a side end face of, and near, the holding portion 25 of each elastic holding piece 17. The slant plane 28 is provided on the same side as the receiving tapered portion 27. When the tabular terminal 2 is laterally inserted, the corner portions of the side face 2*c* of the tabular terminal 2 are put into contact with the slant planes 28.

A core wire of the electric wire (not shown) is crimped with a pair of core wire crimping pieces 13 of the female terminal 1 before the female terminal 1 is received in the fuse accommodating portion 5. A covering portion of the electric wire is crimped with a pair of cover crimping pieces 14. The female terminal 1 with the electric wire is inserted into the terminal accommodating chamber 8 of the fuse accommodating portion 5 from the front end portion of the elastic holding piece 17. When the female terminal 1 is completely accommodated, the lance engaging portion 15 of the female terminal 1 and the lance 9 of the terminal accommodating chamber 8 engage each other. The engaging projection 16 of the female terminal 1 engages the engagement recess of the terminal accommodating chamber 8. The female terminal 1 is locked up in the terminal accommodating chamber 8. The blade-type fuse 3 is inserted into the fuse accommodating chamber 6 of the fuse accommodating portion 5 from the front end portion of the tabular terminal 2. The tabular terminal 2 is inserted between the elastic holding pieces 17 of the female terminal 1.

Figure 7:
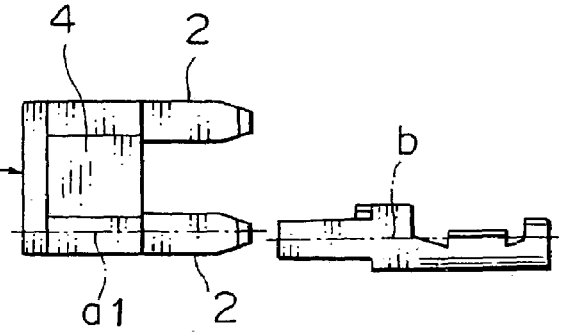
PRIOR ART FIG. 7
FIG. 7 is an explanatory illustration showing an appropriate insertion direction of the fuse into the tabular terminal-use female terminal.

Normally, as shown in FIG. 7, the tabular terminal 2 is inserted in the female terminal 1 in a state that a blade axis a1 of the tabular terminal 2 is in parallel with a longitudinal axis b of the female terminal 1. The front end portion of the tabular terminal 2 is guided into the holding portions 25 by the guide faces 26 of the elastic holding pieces 17. The tabular terminal 2 is inserted between the elastic holding pieces 17. The female terminal 1 is electrically connected to the tabular terminal 2.

The tabular terminal 2 is guided into the guide faces 26 by the guide portion 21 (FIG. 2). The tabular terminal 2 is more securely guided into the elastic holding pieces 17.

Figure 4:
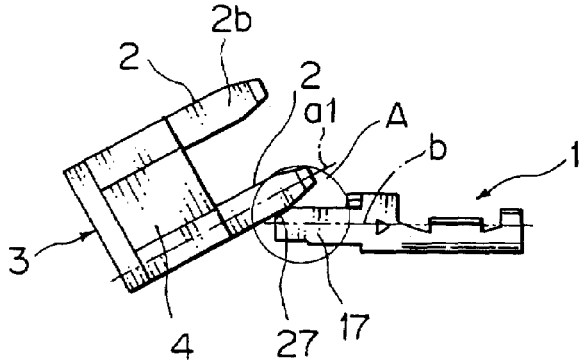
FIG. 4 is an explanatory illustration showing a state that the fuse is laterally put into contact with the inventive tabular terminal-use female terminal.

When the blade-type fuse 3 is inserted into the fuse accommodating portion 5, the blade-type fuse 3 is sometimes laterally inserted (in this specification, "laterally inserted" includes "obliquely included"). When the blade-type fuse 3 is laterally inserted, the corner portions of the side face 2*c* of the tabular terminal 2 are put into contact with the receiving tapered portions of the elastic holding pieces 17 as shown in FIG. 3–FIG. 5.

The elastic holding pieces 17 open due to insertion force of the tabular terminal 2, and the tabular terminal 2 is inserted between the elastic holding pieces 17. Like this, the tabular terminal 2 is inserted without a damage.

Here, the largest gap of the receiving tapered portions 27 is larger than the thickness of the tabular terminal 2.

If the checking plate 18 is provided on the female terminal 1, displacement, from the first side portion 10*a* side toward the fourth side portion 10*d* side, of the elastic holding pieces 17 is restrained. Because the elastic holding pieces 17 open easier, the tabular terminal 2 is easily inserted between the elastic holding pieces 17.

Because the slant plane 28 is formed on each elastic holding piece 17, the tabular terminal 2 can be more easily inserted between the elastic holding pieces 17.

The female terminal 1 can be easily produced from a flat plate by means of the die-cutting and the bending.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A tabular terminal-use female terminal for reception of a tabular terminal, having side faces with corner portions, comprising:

a body;

a pair of elastic holding pieces extending longitudinally from opposite sides of said body in a direction for receiving a tabular terminal, each said elastic holding piece having a face defined peripherally by a pair of side end faces separated in a width direction and extending in the direction for receiving the tabular terminal and a front end, said face of one elastic holding piece being arranged to oppose the face of the other elastic holding piece so as to hold the tabular terminal at a holding portion of each said face, each said elastic holding piece being formed so as to converge toward the other elastic holding piece at said holding portion and diverge from the other elastic holding piece at a guide face portion of said face, said guide face portion extending from said holding portion to said front end of each said elastic holding piece for guiding movement of the tabular terminal toward said holding portion;

a checking plate engageable with both said elastic holding pieces at one side end face of said pair of side end faces of each elastic holding piece, to restrain displacement of said elastic holding pieces in the width direction thereof;

a receiving tapered portion formed as an inclined plane in the surface of the other said side end face of said pair of side end faces of each elastic holding piece along at least a part of said guide face portion beginning at said front end; and a slant plane, formed in the surface of the same side end face of each elastic holding piece as the receiving tapered portion, and extending from said receiving tapered portion to beyond said holding portion, wherein a tabular terminal can be guidedly laterally inserted into the holding portion between said elastic holding pieces of the tabular terminal-use female terminal, such that the corner portions of the side faces of the tabular terminal are put into contact with at least one of said receiving tapered portions and at least one of said slant planes of said pair of elastic holding pieces.

2. The tabular terminal-use female terminal as set forth in claim 1, wherein the convergent and divergent portions of the pair of elastic holding pieces are formed of a rectangular plate having an L-shape.

3. The tabular terminal-use female terminal as set forth in claim 1, wherein a largest gap of the opposed receiving tapered portions is greater than the thickness of the tabular terminal to be inserted into the tabular terminal-use female terminal.

4. The tabular terminal-use female terminal as set forth in claim 3, wherein the convergent and divergent portions of the pair of elastic holding pieces are formed of a rectangular plate having an L-shape.

* * * * *